US010240363B2

(12) United States Patent
Hsu et al.

(10) Patent No.: US 10,240,363 B2
(45) Date of Patent: Mar. 26, 2019

(54) DEADBOLT LOCK ASSEMBLY WITH VISUAL FEEDBACK

(71) Applicant: Spectrum Brands, Inc., Middleton, WI (US)

(72) Inventors: Wei Hsu, Lake Forest, CA (US); Elliott Schneider, Foothill Ranch, CA (US); Yos Singtoroj, Anaheim, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 15/397,515

(22) Filed: Jan. 3, 2017

(65) Prior Publication Data

US 2018/0187452 A1 Jul. 5, 2018

(51) Int. Cl.

| | |
|---|---|
| ***G07C 9/00*** | (2006.01) |
| ***E05B 15/02*** | (2006.01) |
| ***E05B 17/10*** | (2006.01) |
| ***E05B 41/00*** | (2006.01) |
| ***E05B 47/00*** | (2006.01) |
| ***E05B 47/02*** | (2006.01) |
| ***G08B 21/18*** | (2006.01) |

(52) U.S. Cl.

CPC ..... *E05B 17/10* (2013.01); *E05B 15/02* (2013.01); *E05B 41/00* (2013.01); *E05B 47/026* (2013.01); *G07C 9/00174* (2013.01); *G07C 9/00309* (2013.01); *G08B 21/182* (2013.01); *E05B 2047/0094* (2013.01); *G07C 9/00944* (2013.01); *G07C 2009/00984* (2013.01); *G07C 2209/62* (2013.01)

(58) Field of Classification Search

CPC ..... G07C 9/00103; G07C 2209/62; G07C 9/00182; G07C 9/00912; G07C 9/00309; G07C 1/14; G07C 2009/00222

USPC ..... 340/5.32

See application file for complete search history.

(56) References Cited

U.S. PATENT DOCUMENTS

| | | | |
|---|---|---|---|
| 2,914,656 | A | 11/1959 | Keith |
| 3,719,821 | A | 3/1973 | Foreman |
| 4,126,341 | A | 11/1978 | Bradstock |
| 4,196,422 | A | 4/1980 | Swigert et al. |
| 4,559,796 | A | 12/1985 | De Forrest, Sr. |
| 4,683,741 | A | 8/1987 | Fields |

(Continued)

FOREIGN PATENT DOCUMENTS

WO 99/53161 A1 10/1999

OTHER PUBLICATIONS

Apr. 5, 2018—(WO) ISR and WO—App. No. PCT/US17/68950.

*Primary Examiner* — Mark S Blouin

(74) *Attorney, Agent, or Firm* — Banner & Witcoff, Ltd.

(57) ABSTRACT

A deadbolt lock assembly for engaging a door with a visual feedback feature on the exterior assembly of the lock. A plurality of LEDs may be positioned in a linear array on the exterior assembly and may illuminate in a sequence to communicate the movement of the latch when the latch moves away from a door jamb into a locked position. The plurality of LEDs may also illuminate in a sequence to communicate the movement of the latch when the latch moves toward a door jamb into an unlocked position. Additionally, the plurality of LEDs may also be illuminated in a pattern to communicate when the power level in the battery of the deadbolt lock assembly is low.

20 Claims, 11 Drawing Sheets

(56) References Cited

U.S. PATENT DOCUMENTS 4,760,380 A 7/1988 Quenneville et al.
4,777,570 A 10/1988 Littles
5,057,975 A 10/1991 Evigan
5,111,007 A 5/1992 Miller et al.
D349,037 S 7/1994 Carsello
D365,976 S 1/1996 Chiu
5,611,613 A 3/1997 Bergen et al.
D396,798 S 8/1998 Adelmeyer et al.
5,996,383 A 12/1999 Adelmeyer et al.
6,016,677 A * 1/2000 Clark ..... E05B 17/2092 70/416
6,225,903 B1 * 5/2001 Soloway ..... E05B 45/12 307/10.5
6,305,814 B1 10/2001 Giamas
D462,005 S 8/2002 Nakamaru
6,622,537 B2 9/2003 Rodriguez
D488,702 S 4/2004 Hansen
D494,841 S 8/2004 Moon et al.
D513,469 S 1/2006 Gao et al.
D518,353 S 4/2006 Van Handel
7,091,429 B2 8/2006 Case et al.
7,108,387 B1 9/2006 Lucas
D530,185 S 10/2006 Osiecki et al.
D533,047 S 12/2006 Wright et al.
7,172,306 B1 2/2007 Campa
7,210,421 B1 5/2007 Pendergraph
7,248,163 B2 7/2007 Wu
D552,964 S 10/2007 Bogdanov et al.
D552,968 S 10/2007 Roberts et al.
D553,953 S 10/2007 Roberts et al.
D554,974 S 11/2007 Huang
D577,277 S 9/2008 Samhammer et al.
D595,109 S 6/2009 Doucet et al.
D618,081 S 6/2010 Moyer
7,832,887 B2 11/2010 Battle
7,866,195 B2 1/2011 Levine
D635,444 S 4/2011 Roberts, III
D638,276 S 5/2011 Tonizzo et al.
7,990,280 B2 8/2011 Gray
8,037,725 B2 10/2011 Levine
D649,012 S 11/2011 Gartner
8,141,400 B2 * 3/2012 Sorensen ..... E05B 47/068 340/5.54
8,331,544 B2 12/2012 Kraus et al.
D680,416 S 4/2013 Dalton
D682,656 S 5/2013 Cramer et al.
D682,657 S 5/2013 Roberts, III
D682,658 S 5/2013 Cramer et al.
D684,842 S 6/2013 Chan et al.
D701,748 S 4/2014 Weathersby et al.
D722,260 S 2/2015 Warmenhoven et al.
D722,633 S 2/2015 Au
D732,923 S 6/2015 Rechberg et al.
D733,522 S 7/2015 Kim et al.
9,085,919 B2 * 7/2015 Bacon ..... E05B 13/10
D736,591 S 8/2015 Groleski et al.
D736,596 S 8/2015 Warmenhoven et al.
D737,118 S 8/2015 Chan et al.
D737,661 S 9/2015 Chan
D755,037 S 5/2016 Czerwinski, Jr. et al.
9,441,403 B2 * 9/2016 Kraus ..... E05B 85/16
9,443,364 B2 * 9/2016 Snider ..... G07C 9/00174
9,617,757 B2 * 4/2017 Lowder ..... E05B 63/08
D790,950 S 7/2017 Kraus et al.
D795,041 S 8/2017 Oliva Camacho et al.
2003/0063009 A1 4/2003 Pelletier et al.
2004/0066647 A1 4/2004 Brady
2005/0248931 A1 11/2005 Alvarez
2006/0213243 A1 9/2006 Bosin
2009/0180277 A1 7/2009 Falce
2012/0073338 A1 3/2012 Mohla
2012/0234058 A1 9/2012 Neil et al.
2013/0237193 A1 9/2013 Dumas et al.
2014/0033773 A1 2/2014 Myers et al.
2014/0260449 A1 9/2014 Uyeda et al.
2015/0126234 A1 5/2015 Rodriguez

* cited by examiner

DEADBOLT LOCK ASSEMBLY WITH VISUAL FEEDBACK

TECHNICAL FIELD

The disclosure relates generally to a deadbolt lock assembly with a visual feedback mechanism to communicate the movements of the lock to the user.

BACKGROUND

As many items being used in everyday life have become enhanced with wireless and remote type communications, the need to communicate effectively with the user the movements of these devices has become more important. For example, if a user has a wireless entry mechanism such as a lock for a door that can be locked and unlocked using a wireless communication device, the lock may unlock or lock without the user physically touching the lock. Without that physical touch, the user may not have confirmation that the lock has successfully locked or unlocked the door. Thus, a lock assembly that can provide visual feedback to a user to effectively communicate the movements of the lock assembly would be beneficial.

BRIEF SUMMARY

Aspects of this disclosure relate a deadbolt lock assembly that includes a latch for locking and unlocking a door in which the deadbolt lock assembly is engaged and an exterior assembly in communication with the latch. The exterior assembly may comprise a face plate, a keyway, and a plurality of LEDs. The plurality of LEDs may be aligned in a horizontal linear array located on the face plate wherein the linear array has a first end furthest from a door jamb and a second end nearest the door jamb. The plurality of LEDs may be arranged in a horizontal linear array and may be oriented substantially parallel to the latch.

Additionally, the deadbolt lock assembly may comprise a processor, wherein the processor is connected to a power source and the plurality of LEDs. The deadbolt lock assembly may further comprise a non-transitory computer readable medium storing computer readable instructions that, when executed by the processor, causes the processor to at least: authenticate a signal from a wireless device to move the latch to a locked position or an unlocked position; instruct the plurality of LEDs to illuminate in a lock sequence when the signal is to move the latch to the locked position; and instruct the plurality of LEDs to illuminate in an unlock sequence when the signal is to move the latch to the unlocked position, wherein the lock sequence is different than the unlock sequence.

The lock sequence may include illuminating the LEDs in a sequence that moves in the same direction as the movement of the latch from the unlocked position to the locked position such that the LED sequence moves toward the door jamb. Further, the lock sequence may include the plurality of LEDs illuminating starting with a first LED nearest the first end illuminates first and then each remaining LED individually and sequentially illuminates starting with the LED immediately next to the first LED after a predetermined time, T1, until all of the plurality of LEDs are illuminated. Lastly, the lock sequence may further include wherein upon waiting a predetermined time, T2, instruct all of the plurality of LEDs to turn off; and upon waiting a predetermined time, T3, instruct a first and a second LED nearest the second end of the horizontal linear array to illuminate.

The unlock sequence may include illuminating the LEDs in a sequence to illuminate in a pattern that moves in the same direction as the movement of the latch from the locked position to the unlocked position such that the LED sequence moves away from the door jamb away from the door jamb. The unlock sequence may further include the plurality of LEDs illuminating starting with a first LED nearest the second end illuminates first and then each remaining LED individually and sequentially illuminates after a predetermined time, T1, until all of the plurality of LEDs are illuminated. Lastly, the unlock sequence may further include upon waiting a predetermined time, T2, instruct all of the plurality of LEDs to turn off; and upon waiting a predetermined time, T3, instruct a first and a second LED nearest first end of the horizontal linear array to illuminate.

In another aspect of the invention, the deadbolt lock assembly may comprise a processor, wherein the processor is connected to a power source and the plurality of LEDs, and a non-transitory computer readable medium storing computer readable instructions that, when executed by the processor, causes the processor to at least: determine when a power level of the power source is below a predetermined threshold limit; and upon determining the power level of the power source is below the predetermined threshold limit, instruct the plurality of LEDs to illuminate in a low power sequence, wherein the low power sequence includes the plurality of LEDs illuminating with the most centrally located LEDs illuminating and remaining illuminated for a predetermined time, T.

In yet another aspect of the invention, the deadbolt lock assembly may comprise a processor, wherein the processor is connected to a power source and the plurality of LEDs, and a non-transitory computer readable medium storing computer readable instructions that, when executed by the processor, causes the processor to at least: determine when a power level of a key fob is below a predetermined threshold limit; and upon determining the power level of the key fob is below a predetermined limit, instruct the outermost located LEDs to illuminate and remain illuminated for a predetermined time, T.

In another aspect of the invention, the deadbolt lock assembly may comprise a processor, wherein the processor is connected to a power source and the plurality of LEDs, and a non-transitory computer readable medium storing computer readable instructions that, when executed by the processor, causes the processor to at least: during a power up phase, instruct all of the plurality of LEDs to illuminate with a first color; after a predetermined time, T, instruct all of the plurality of LEDs to illuminate and change from the first color to a second color different from the first color; and after another predetermined time, T, instruct all of the plurality of LEDs to illuminate and change from the second color to a third color different from the first color and the second color.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE DRAWINGS

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention. The reader is advised that the attached drawings are not necessarily drawn to scale.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

Figure 1A:
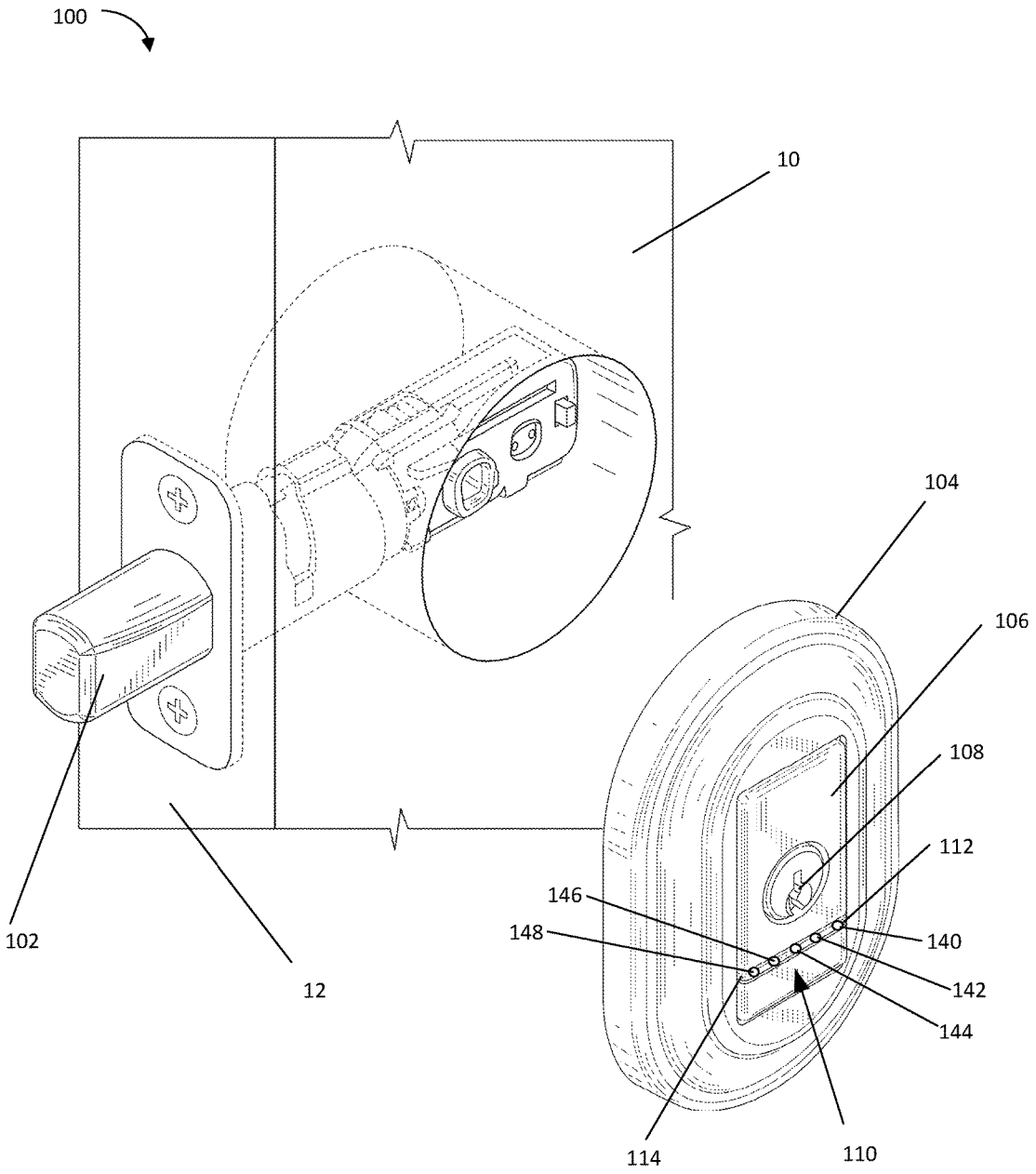
FIGS. 1A and 1B illustrate an exploded perspective view of an exemplary deadbolt lock assembly as described in this disclosure.
Figure 1B:
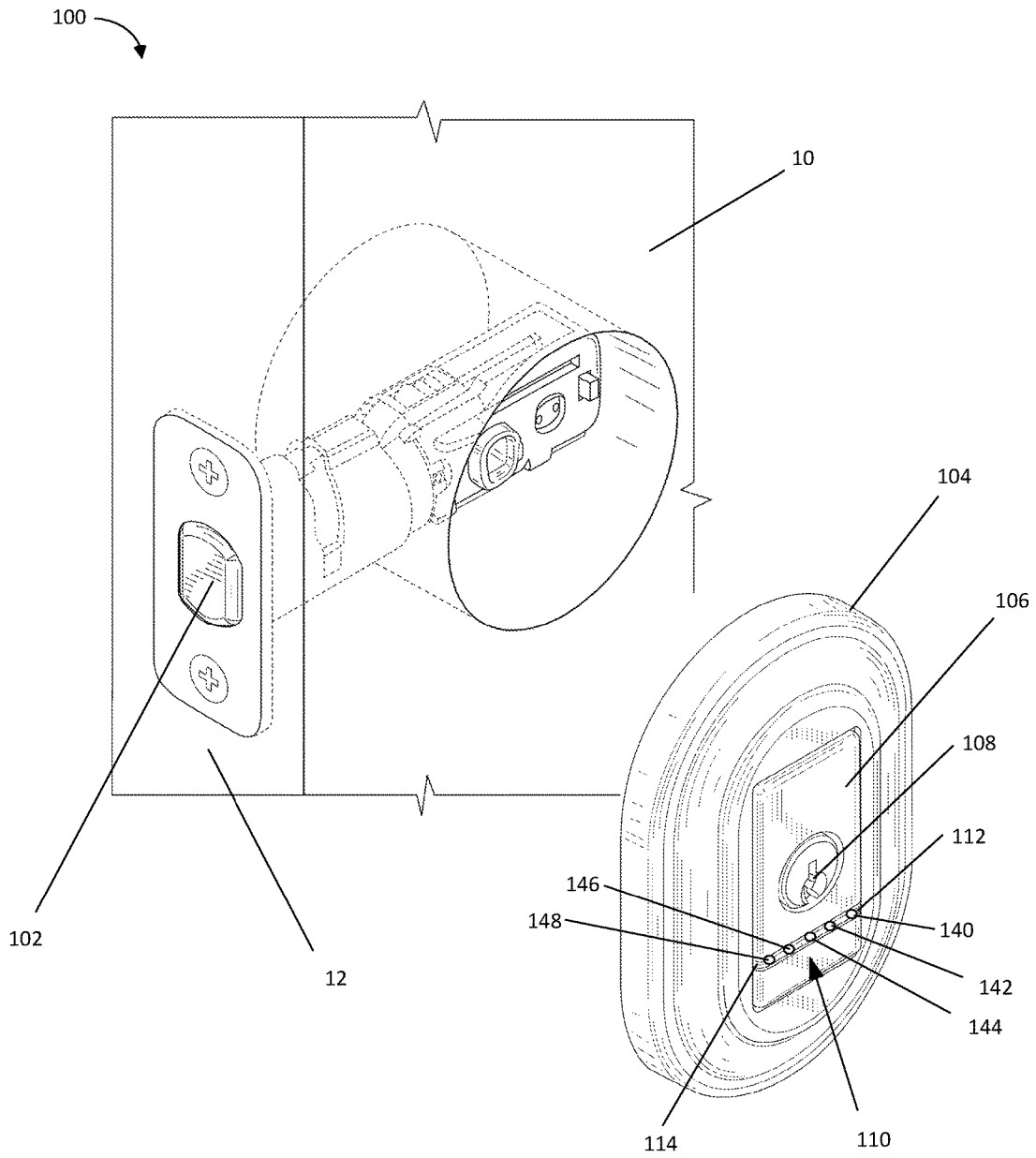

FIGS. 1A and 1B illustrate exploded views of the exterior of an exemplary deadbolt lock assembly 100. The deadbolt lock assembly 100 may be used for a door 10 such as an entryway door into a dwelling. The deadbolt lock assembly may comprise a latch 102 for locking and unlocking the door 10 in which the deadbolt lock assembly 100 is engaged. The latch 102 may be oriented substantially perpendicular to a door jamb 12 and be configured to extend away from the door jamb 12 where the latch 102 is extended beyond the door jamb 12 as shown in FIG. 1A. FIG. 1A illustrates the locked position. Similarly, FIG. 1B illustrates the unlocked position where the latch 102 is retracted toward the door jamb 12 and does not extend beyond the door jamb 12. The latch 102 may be a similar to any deadbolt type latch known to own skilled in the art. The latch 102 may be oriented in a substantially horizontal orientation or alternatively may be oriented in a vertical or angled orientation. The deadbolt lock assembly 100 may further comprise an exterior assembly 104 that is in communication with the latch 102 via a mechanical engagement as known to one skilled in the art. The exterior assembly 104 may also comprise a face plate 106, and a plurality of LEDs 110 aligned in a horizontal linear array on the face plate 106. Alternatively, the exterior assembly 104 may further comprise a keyway 108 positioned on the face plate 106, wherein the latch 102 is independently movable when a matching key is inserted into the keyway 108 and turned. The plurality of LEDs 110 may be evenly spaced apart or alternatively, may not be evenly spaced apart. The plurality of LEDs 110 may be arranged in a linear array having a first end 112 positioned furthest away from the door jamb 12 and a second end 114 positioned nearest to the door jamb 12. The plurality of LEDs 110 may be oriented substantially parallel to the orientation of the latch 102 and the movement of the latch 102 when the latch 102 moves from an unlocked position to a locked position or alternatively when the latch 102 moves from a locked position to an unlocked position. The plurality of LEDs 110 may comprise any number of LEDs, such as five LEDs as shown in the exemplary embodiment or may comprise 3 LEDs, 4 LEDs, 6 LEDs, 7 LEDs or even more.

For example, in the exemplary embodiment shown in FIGS. 1A-1B and 4-9B, the plurality of LEDs 110 comprises five LEDs, arranged horizontally in a linear array. LED 140 is the LED furthest from the door jamb 12 and nearest the first end 112, LED 142 is positioned next to LED 140 closer to the door jamb 12, LED 144 is positioned in the center of the plurality of LEDs 110, LED 146 is next to the center LED 144 moving toward the second end 114, and lastly LED 148 is nearest the second end 114.

In the exemplary embodiment, the plurality of LEDs 110 may be configured such that when the latch 102 is moved from an unlocked position to the locked position shown in FIG. 1A, the plurality of LEDs 110 may illuminate in a sequence starting at the first end 112 of the linear array with the LED 140 nearest the first end 112 illuminating first and then each remaining LED individually and sequentially illuminating after a predetermined time, T1, starting with the LED 142 immediately next to the first LED 140 until all of the plurality of LEDs are illuminated into a locked position. The plurality of LEDs 110 being illuminated in this sequence visually communicates to the user the movement of the latch 102 away from the door jamb 12. Similarly, the plurality of LEDs 110 may be configured such that when the latch 102 is moved from the locked position to the unlocked position shown in FIG. 1B, the plurality of LEDs 110 may illuminate in a sequence starting at the second end 114 of the linear array with the LED 148 nearest the second end 114 illuminating first and then each remaining LED individually and sequentially illuminating after a predetermined time, T1, starting with the LED 146 immediately next to the first LED 148 until all of the plurality of LEDs are illuminated. The plurality of LEDs 110 being illuminated in this sequence visually communicates to the user the movement of the latch 102 toward from the door jamb 12 into an unlocked position.

Figure 2:
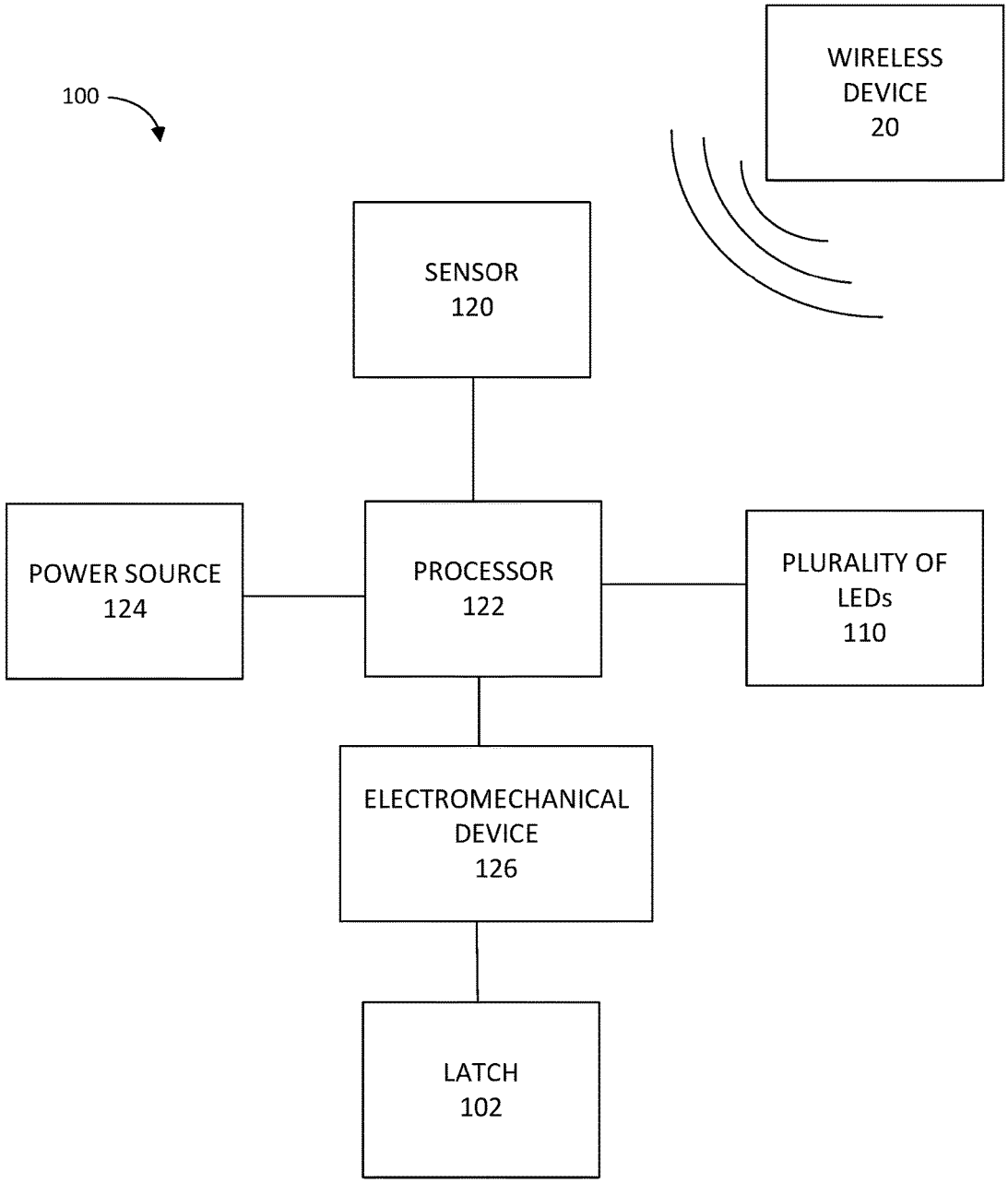
FIG. 2 illustrates a schematic diagram of the deadbolt lock assembly as described in this disclosure.

In addition, as shown in FIG. 2, the deadbolt assembly 100 may also include a sensor 120, a processor 122, a power source or battery 124, and an electromechanical device 126 configured to move the latch 102 from a locked to an unlocked position. The sensor 120 may be configured to receive a wireless signal from a key fob or other wireless device 20. The signal may instruct the deadbolt assembly 100 to move from a locked position to an unlocked position or alternatively from an unlocked position to a locked position.

The deadbolt assembly may also include an interior assembly that may be mounted to the opposite side of the door 10 from the exterior assembly 104. The interior assembly may connect to the latch 102 as well as connect to the exterior assembly 104. The interior assembly may further comprise a manual switch to move the latch 102 from a locked position to an unlocked position or alternatively from an unlocked position to a locked position. The interior assembly may further comprise a removable cover that allows the user access to the power source or battery 124. The processor 122 may be a general-purpose processor, a digital signal processor (DSP), an application-specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, or any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. The one or more implementations described throughout this disclosure may utilize logical blocks, modules, and circuits that may be implemented or performed with a processor 122.

The processor 122 may be used to implement various aspects and features described herein. As such, the processor 122 may be configured to execute multiple calculations, in parallel or serial and may execute coordinate transformations, curve smoothing, noise filtering, outlier removal, amplification, and summation processes, and the like. The processor 122 may include a processing unit and system memory to store and execute software instructions. The processor 122 may include a non-transitory computer readable medium that stores computer readable instructions that, when executed by the processor, causes the processor to perform specific functions with the deadbolt assembly 100.

The power source 124 may be a battery or other type of electrical power source. While the electromechanical device 126 may be any device known to own skilled in the art to convert electrical energy to mechanical movement to extend and retract the latch 102.

Figure 3:
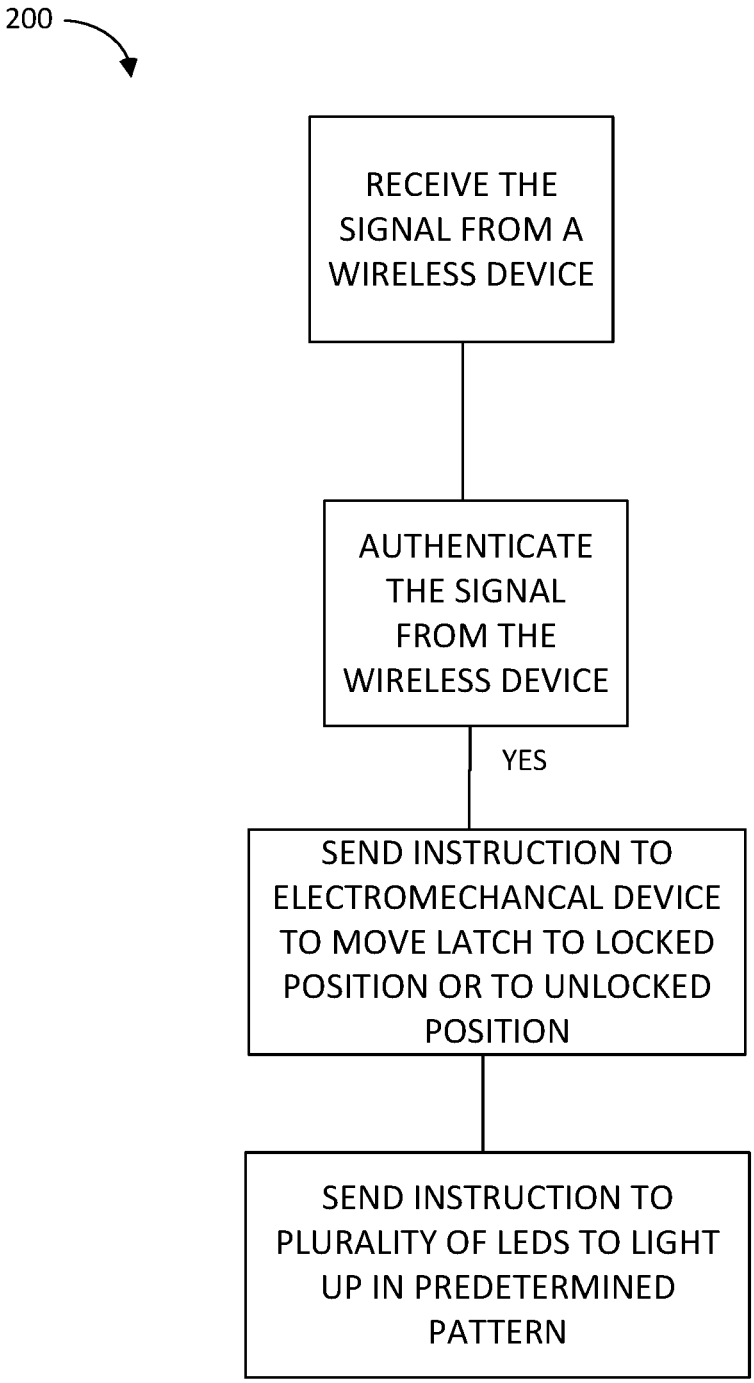
FIG. 3 illustrates a flowchart of the deadbolt lock assembly process for lighting up the plurality of LEDs during the locking and unlocking process.

The process 200 for illuminating the plurality of LEDs 110 during the locking and unlocking process is shown in FIG. 3. Upon receiving the signal, the processor 122 may determine if there are any errors within the system. If there are no errors, the processor 122 may instruct the electromechanical device 126 to move the latch 102 either to a locked position to an unlocked position or alternatively from an unlocked position to a locked position. In addition, the processor 122 may instruct the plurality of LEDs 110 to illuminate or light up in a directional pattern that moves in the same direction as the latch 102 to indicate the direction the latch 102 moved. If the processor 122 determines any errors within the system, such as a low power remaining within the battery 124, the processor 122 may instruct the plurality of LEDs 110 to light up in a specific pattern depending upon the error to effectively communicate the error to the user to troubleshoot the system. This will be described in more detail below.

While the processor 122 is authenticating the signal from the wireless device, the processor 122 may instruct the plurality of LEDs 110 to illuminate a pair of LEDs in a sweeping motion such that a first and a second LED nearest the second end 114 are illuminated where the first and second LED are adjacent each other, then after a 150 ms delay, the first LED is turned off and a third LED is illuminated, where the third LED is adjacent the second LED. Similarly, after another 150 ms delay, the second LED is turned off while a fourth LED is illuminated, where the fourth LED is adjacent the third LED. This process is repeated until the two LEDs nearest the first end 112 are illuminated. Then, the sweeping motion is reversed where the LEDs that are illuminated move back toward the second end 114. This process may be repeated as necessary while the processor 122 is authenticating the signal. This LED illumination pattern during the authentication process may communicate to the user that the signal has been received.

Locking the Deadbolt Assembly

Once the processor 122 has authenticated the signal to lock the deadbolt assembly, the processor 122 may instruct electromechanical device 126 to extend the latch 102 to a locked position and also instruct the plurality of LEDs 110 to light up or illuminate in a lock sequence that moves in the same direction movement of the extended latch 102 such that the LED sequence moves toward the door jamb 12.

Once the processor 122 has authenticated the signal to lock the deadbolt assembly 100, the processor 122 may instruct the plurality of LEDs 110 to visually communicate the directional illumination pattern/sequence that the latch 102 moves toward the door jamb 12 as shown in FIGS. 4A-4G. Starting with all of the LEDs turned off, the processor 122 may instruct LED 140 to be illuminated. Next, after a predetermined amount of time, T1, the LED 142 immediately next to LED 140 may be illuminated, such that both LEDs 140 and 142 may be illuminated. Next, again after the predetermined amount of time, T1, LED 144 may be illuminated, such that three LEDs 140, 142, and 144 are illuminated. Again after a predetermined amount of time, T1, LED 146 may be illuminated, such that four LEDs 140, 142, 144, and 146 are illuminated. Lastly, after a predetermined amount of time, T1, LED 148 may be illuminated, such that all five LEDs 140, 142, 144, 146, and 148 are illuminated. In addition to the locking sequence, or as an alternative to the animated locking sequence, after a second predetermined amount of time, T2, all of the LEDs may turn off and then after a third predetermined amount of time, T3, only the two LEDs 146, 148 nearest the second end 114 may be illuminated and remain illuminated for a predetermined amount of time, T4. Table 1 below shows the time interval, which LEDs may be illuminated, and the corresponding figure for each stage of the lock sequence.

TABLE 1

EXEMPLARY LOCKING SEQUENCE - LOCKING MOVEMENT LED SEQUENCE

Figure 4A:
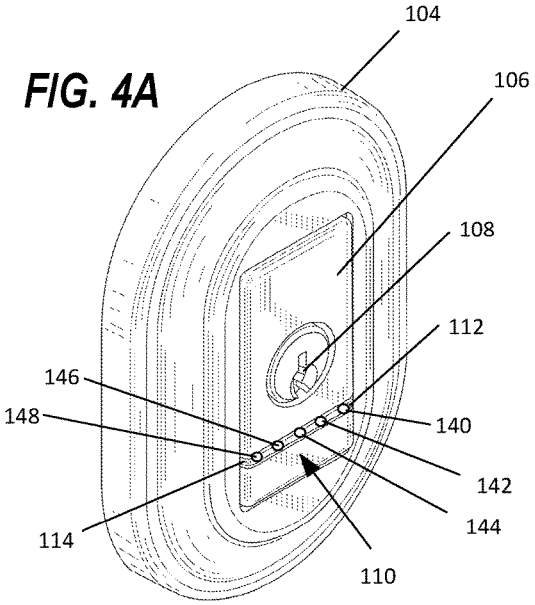
FIGS. 4A-4G illustrates a perspective view of the exterior assembly of the deadbolt lock assembly of FIG. 1 during a locking process.
Figure 4B:
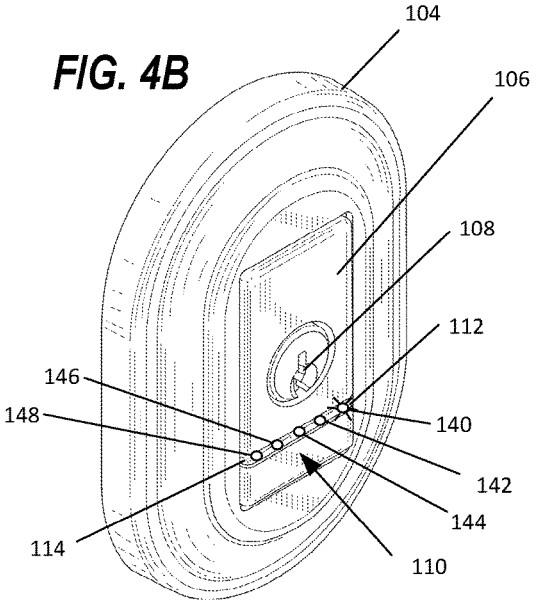
Figure 4C:
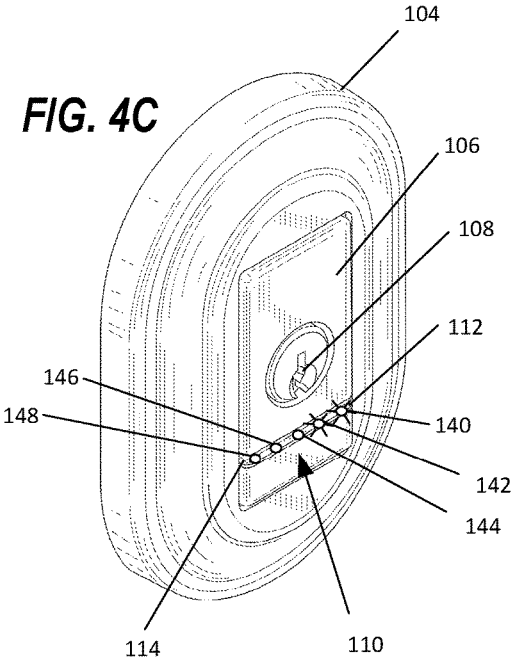
Figure 4D:
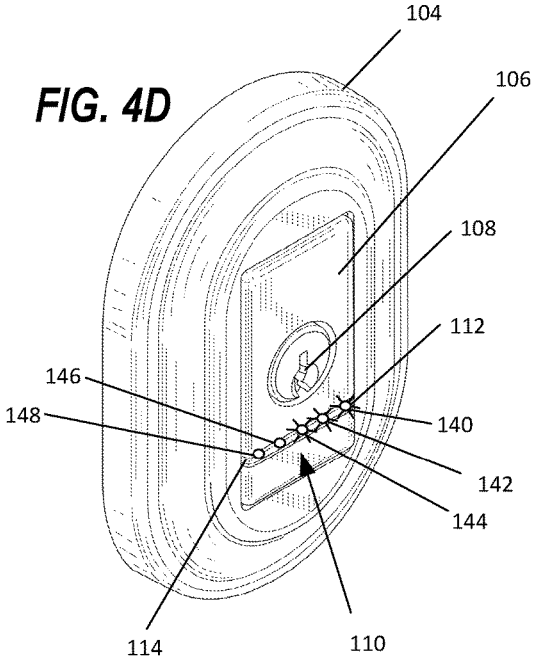
Figure 4E:
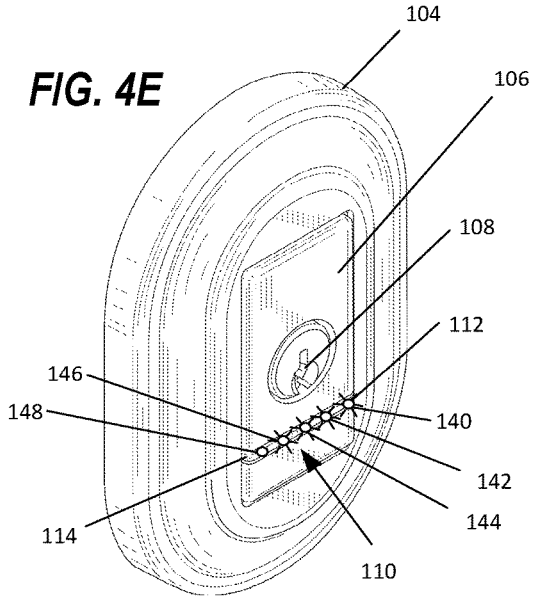
Figure 4F:
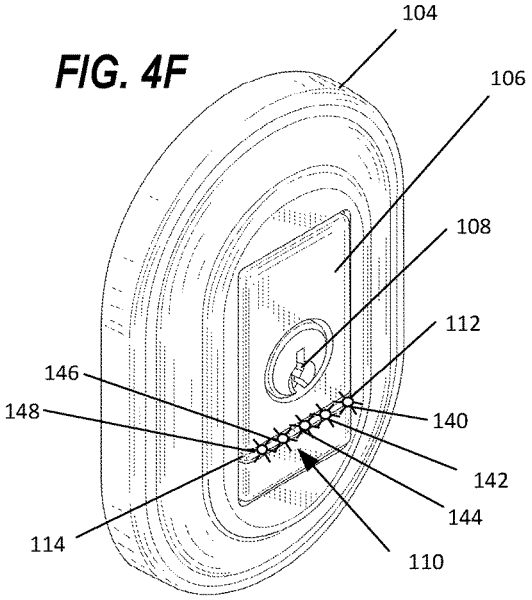
Figure 4G:
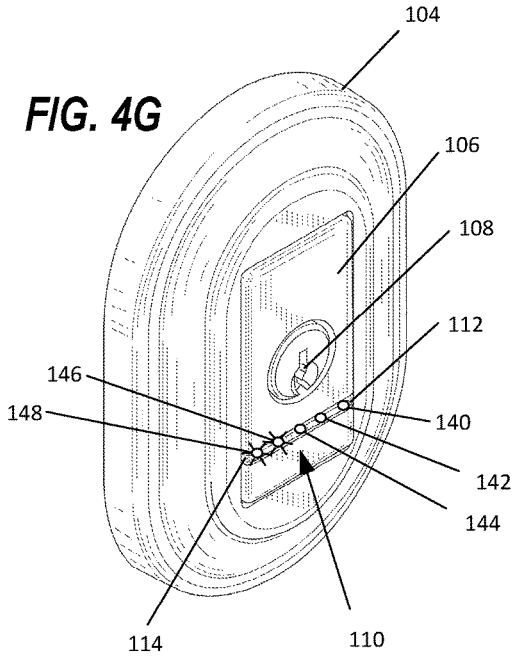

| EXEMPLARY TIME INTERVAL | LEDs ILLUMINATED | CORRESPONDING FIG. |
|---|---|---|
| — | NONE | FIG. 4A |
| T0 | Single LED 140 furthest from Door Jamb | FIG. 4B |
| T1 | Two LEDS 140, 142 | FIG. 4C |
| T1 | Three LEDS 140, 142, 144 | FIG. 4D |
| T1 | Four LEDs 140, 142, 144, 146 | FIG. 4E |
| T1 | ALL LEDs 140, 142, 144, 146, 148 | FIG. 4F |
| T2 | NONE | FIG. 4A |
| T3 | LEDs 146, 148 | FIG. 4G |

TABLE 1-continued

| EXEMPLARY LOCKING SEQUENCE - LOCKING MOVEMENT LED SEQUENCE | | |
|---|---|---|
| EXEMPLARY TIME INTERVAL | LEDs ILLUMINATED | CORRESPONDING FIG. |
| T4 | NONE | FIG. 4A |

Alternatively, once the processor 122 has authenticated the signal to lock the deadbolt assembly 100, the processor 122 may instruct the plurality of LEDs 110 to visually communicate the directional illumination pattern that the latch 102 moves toward the door jamb 12 with a single LED sweeping motion across the plurality of LEDs 110. Starting with all of the LEDs turned off, the processor 122 may instruct LED 140 to be illuminated. Next, after a predetermined amount of time, T1, the LED 142 immediately next to LED 140 may be illuminated, while turning off LED 140 such that only LED 142 may be illuminated. Next, again after the predetermined amount of time, T1, LED 144 may be illuminated, while turning off LED 142, such that only LEDs 144 may be illuminated. Again after a predetermined amount of time, T1, LED 146 may be illuminated, while turning off LED 144, such that only LED 146 may be illuminated. Lastly, after a predetermined amount of time, T1, LED 148 may be illuminated, while turning off LED 146, such that only LED 148 is illuminated. Similar to described above, after a second predetermined amount of time, T2, all of the LEDs may turn off and then after a third predetermined amount of time, T3, only the two LEDs 146, 148 nearest the second end 114 may be illuminated and remain illuminated for a predetermined amount of time, T4. Table 2 below shows the time interval and which LEDs may be illuminated for each stage of the lock sequence.

TABLE 2

| ALTERNATE LOCKING SEQUENCE - LOCKING MOVEMENT LED SEQUENCE | |
|---|---|
| EXEMPLARY TIME INTERVAL | LEDs ILLUMINATED |
| — | NONE |
| T0 | Single LED 140 furthest from Door Jamb |
| T1 | LED 142 |
| T1 | LED 144 |
| T1 | LED 146 |
| T1 | LED 148 |
| T2 | NONE |
| T3 | LEDs 146, 148 |
| T4 | NONE |

As yet another alternate directional illumination pattern for the locking sequence, once the processor 122 has authenticated the signal to lock the deadbolt assembly 100, the processor 122 may instruct the plurality of LEDs 110 to visually communicate the directional illumination pattern that the latch 102 moves toward the door jamb 12 with a two LED sweeping motion. Starting with all of the LEDs turned off, the processor 122 may instruct LED 140 to be illuminated. Next, after a predetermined amount of time, T1, the LED 142 immediately next to LED 140 may be illuminated, such that only LEDs 140 and 142 may be illuminated. (As an alternate option, both LEDs 140 and 142 may be illuminated as the initial step). Next, again after the predetermined amount of time, T1, LED 144 may be illuminated, while turning off LED 140, such that only LEDs 142 and 144 may be illuminated. Again after a predetermined amount of time, T1, LED 146 may be illuminated, while turning off LED 142, such that only LEDs 144 and 146 may be illuminated. Lastly, after a predetermined amount of time, T1, LED 148 may be illuminated, while turning off LED 144, such that only LED 146 and 148 may be illuminated. Similar to described above, after a second predetermined amount of time, T2, all of the LEDs may turn off and then after a third predetermined amount of time, T3, only the two LEDs 146, 148 nearest the second end 114 may be illuminated and remain illuminated for a predetermined amount of time, T4. Table 3 below shows the time interval and which LEDs may be illuminated for each stage of the lock sequence. Other embodiments of a directional illumination pattern to visually communicate the movement of the latch 102 using a linear array of LEDs 110 from an unlocked position to a locked position may be obvious to one skilled in the art.

TABLE 3

| ALTERNATE LOCKING SEQUENCE - LOCKING MOVEMENT LED SEQUENCE | |
|---|---|
| EXEMPLARY TIME INTERVAL | LEDs ILLUMINATED |
| — | NONE |
| T0 | Single LED 140 furthest from Door Jamb |
| T1 | LEDs 140, 142 |
| T1 | LEDs 142, 144 |
| T1 | LEDs 144, 146 |
| T1 | LEDs 146, 148 |
| T2 | NONE |
| T3 | LEDs 146, 148 |
| T4 | NONE |

An exemplary embodiment of the time sequence is described below. The predetermined time, T0, may be the amount of time before the first LED illuminates after the processor has authenticated the signal to move the latch 102 to the locked position. T0 may be approximately 150 ms or within a range of 100 ms to 200 ms. The predetermined time interval, T1, may be less than the time intervals T0, T2, T3, and T4 to give the appearance of motion as the plurality of LEDs 110 illuminate in succession. For example, T1 may be approximately 100 ms or within a range of 50 ms to 150 ms. T2 is the time that all of the LEDs remain illuminated after they have been sequentially illuminated and may be greater than the time interval T1. For instance, T2 may be approximately 300 ms or within the range of 200 ms to 400 ms. T3 is the time that the LEDs remain turned off after sequentially illuminating. An additional signal may be sent so that the two LEDs 146, 148 closest to the door jamb 12 may be illuminated to give another indication that the latch 102 was moved toward the door jamb 12 to the locked position. The time interval, T3, may be greater than T0, T1, and T2 and may be approximately 1400 ms or within a range of 800 ms to 2000 ms. Lastly, T4 is the time that the LEDs 146, 148 remain illuminated. T4 may be greater than T1, T2, and T3 to give the user the longest visual cue that the latch has been moved to the locked position. T4 may be approximately 2000 ms or within a range of 1500 ms to 3000 ms. After the time interval T4, the LEDs 110 remain turned off until the next interaction of the deadbolt lock assembly 100 with the user.

Unlocking the Deadbolt Assembly

The process for visually communicating the unlocking motion of the latch 102 of the deadbolt assembly 100 is similar to the visual communication for the locking motion. Once the processor 122 has authenticated the signal to unlock the deadbolt assembly, the processor 122 may instruct electromechanical device 126 to move the latch 102 in a direction away from the door jamb 12 and also instruct the plurality of LEDs 110 to light up or illuminate in a pattern that moves in the same direction away from the door jamb 12. As discussed above, the plurality of LEDs 110 may be arranged horizontally in a linear orientation having a first end 112 positioned furthest away from the door jamb 12 and a second end 114 positioned nearest to the door jamb 12.

For example, the exemplary embodiment of the exterior assembly 104 shown FIGS. 5A-5G illustrate the unlock sequence of the plurality of LEDs as they light up to show the movement of the latch 102 away from the door jamb 12. Once the processor 122 has authenticated the signal to unlock the deadbolt assembly 100, the processor 122 may instruct the plurality of LEDs 110 to visually communicate the directional illumination pattern/sequence that the latch 102 moves away from the door jamb 12. Starting with all of the LEDs 110 turned off, after a predetermined time interval, T0, the LED 148 may be illuminated. Next after a predetermined amount of time, T1, the LED 146 immediately next to LED 148 is illuminated, such that both LEDs 148 and 146 may be illuminated. Next, again after the predetermined amount of time, T1, LED 144 may be illuminated, such that three LEDs 148, 146, and 144 are illuminated. Again after a predetermined amount of time, T1, LED 142 may be illuminated, such that four LEDs 148, 146, 144, and 142 are illuminated. Lastly, after a predetermined amount of time, T1, LED 140 may be illuminated, such that all five LEDs 148, 146, 144, 142, and 140 are illuminated. In addition to the unlocking sequence, or as an alternative to the animated unlocking sequence, after a second predetermined amount of time, T2, all of the LEDs may turn off and then after a third predetermined amount of time, T3, only the two LEDs 142, 140 nearest the first end 112 may be illuminated and remain illuminated for a predetermined amount of time, T4. Table 4 below shows the time interval, which LEDs are illuminated, and the corresponding figure for each stage in the unlock sequence.

TABLE 4

EXEMPLARY UNLOCKING SEQUENCE - UNLOCKING MOVEMENT LED SEQUENCE

Figure 5A:
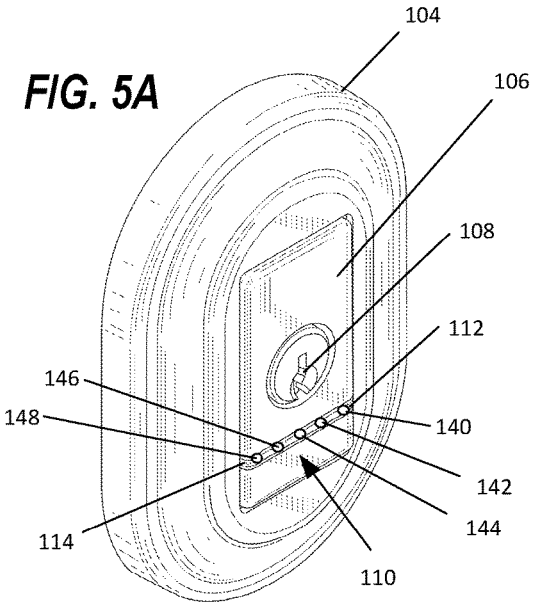
FIGS. 5A-5G illustrates a perspective view of the exterior assembly of the deadbolt lock assembly of FIG. 1 during an unlocking process.
Figure 5B:
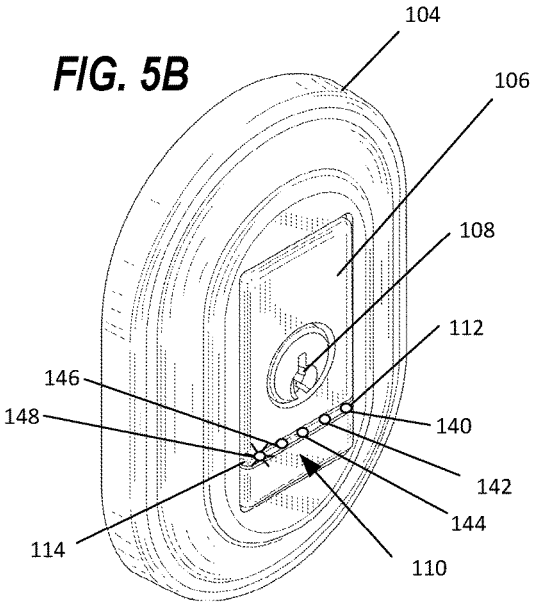
Figure 5C:
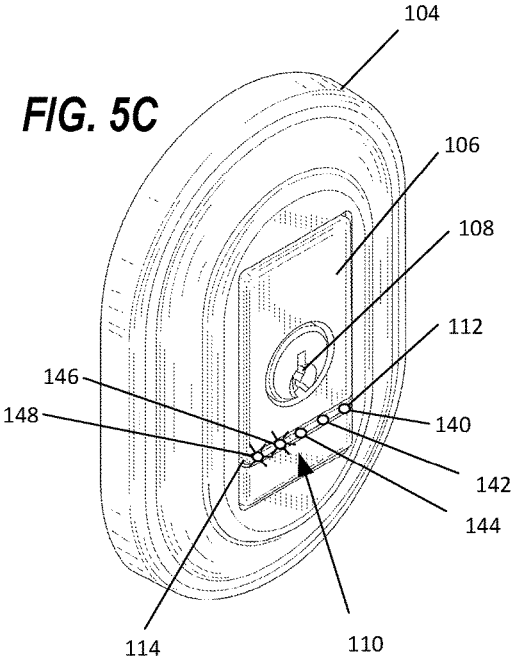
Figure 5D:
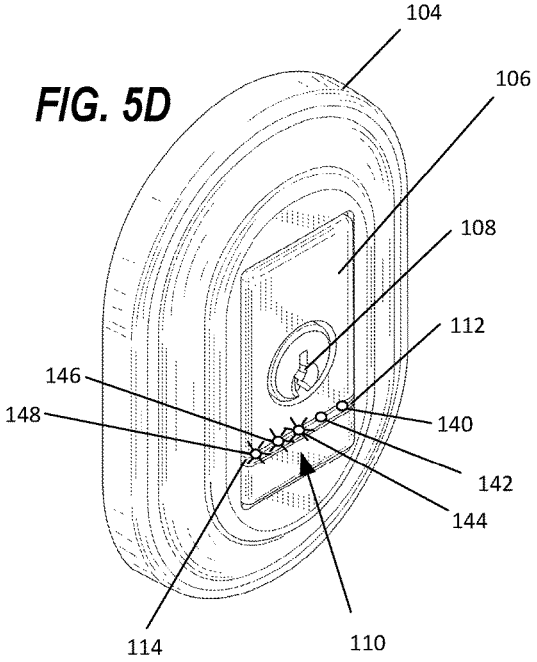
Figure 5E:
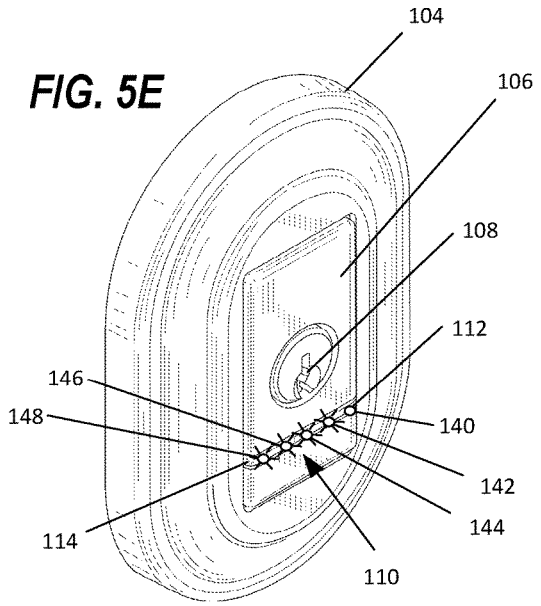
Figure 5F:
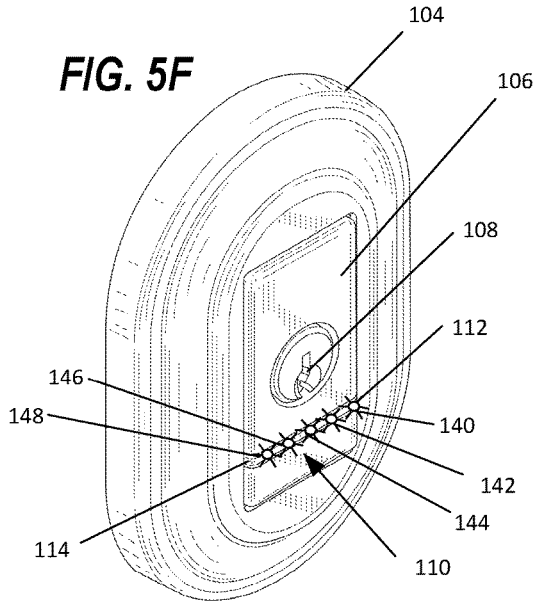
Figure 5G:
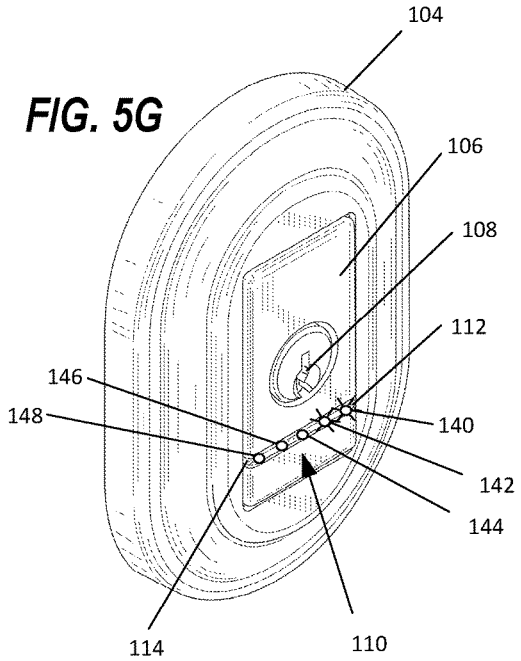
Figure 6:
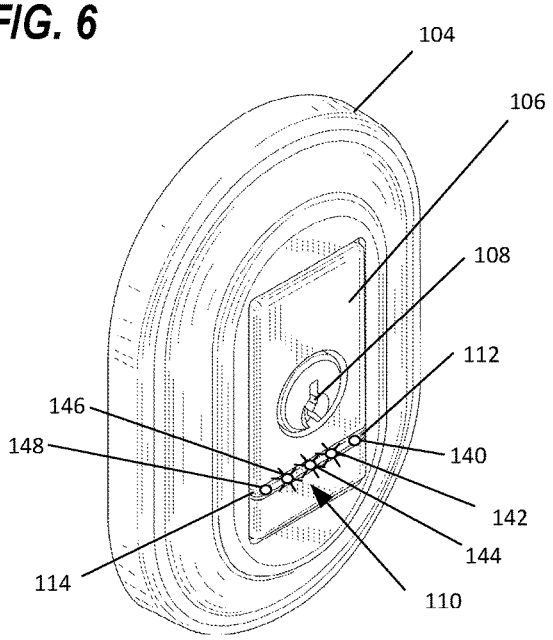
FIG. 6 illustrates a perspective view of the exterior assembly of the deadbolt lock assembly of FIG. 1 communicating a low battery in the deadbolt lock assembly.
Figure 7:
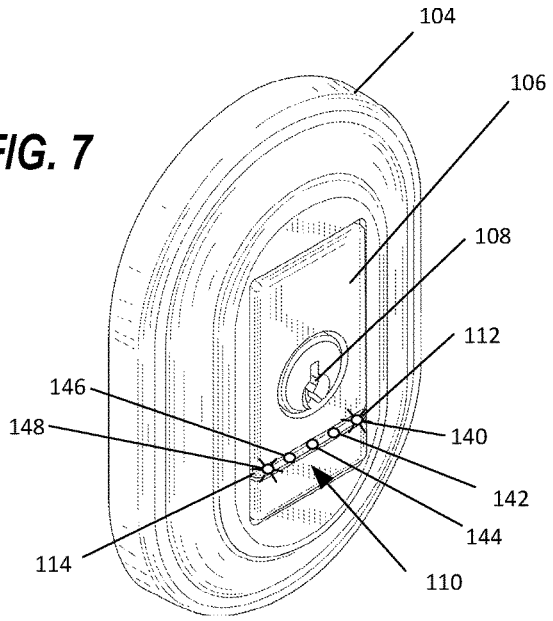
FIG. 7 illustrates a perspective view of the exterior assembly of the deadbolt lock assembly of FIG. 1 communicating a low battery in a key fob.

| EXEMPLARY TIME INTERVAL | LEDs ILLUMINATED | CORRESPONDING FIG. |
|---|---|---|
| — | NONE | FIG. 5A |
| T0 | Single LED 148 nearest to Door Jamb | FIG. 5B |
| T1 | Two LEDS 148, 146 | FIG. 5C |
| T1 | Three LEDS 148, 146, 144 | FIG. 5D |
| T1 | Four LEDs 148, 146, 144, 142 | FIG. 5E |
| T1 | ALL LEDs 148, 146, 144, 142, 140 | FIG. 5F |
| T2 | NONE | FIG. 5A |
| T3 | LEDs 142, 140 | FIG. 5G |
| T4 | NONE | FIG. 5A |

Alternatively, once the processor 122 has authenticated the signal to unlock the deadbolt assembly 100, the processor 122 may instruct the plurality of LEDs 110 to visually communicate the directional pattern/sequence that the latch 102 moves away from the door jamb 12 with a single LED sweeping motion across the plurality of LEDs 110. Starting with all of the LEDs 110 turned off, after a predetermined time interval, T0, the LED 148 may be illuminated. Next after a predetermined amount of time, T1, the LED 146 immediately next to LED 148 is illuminated, while turning off LED 148, such that only LED 146 may be illuminated. Next, again after the predetermined amount of time, T1, LED 144 may be illuminated, while turning off LED 146, such that only LED 144 may be illuminated. Again after a predetermined amount of time, T1, LED 142 may be illuminated, while turning off LED 144, such that only LED 142 may be illuminated. Lastly, after a predetermined amount of time, T1, LED 140 may be illuminated, while turning off LED 142, such that only LEDs 140 may be illuminated. Similarly to described above, after a second predetermined amount of time, T2, all of the LEDs may turn off and then after a third predetermined amount of time, T3, only the two LEDs 142, 140 nearest the first end 112 may be illuminated and remain illuminated for a predetermined amount of time, T4. Table 5 below shows the time interval and which LEDs are illuminated for each stage in the unlock sequence.

TABLE 5

ALTERNATE UNLOCKING SEQUENCE - UNLOCKING MOVEMENT LED SEQUENCE

| EXEMPLARY TIME INTERVAL | LEDs ILLUMINATED |
|---|---|
| — | NONE |
| T0 | Single LED 148 nearest to Door Jamb |
| T1 | LED 146 |
| T1 | LED 144 |
| T1 | LED 142 |
| T1 | LED 140 |
| T2 | NONE |
| T3 | LEDs 142, 140 |
| T4 | NONE |

As yet another alternate directional illumination pattern for the unlocking sequence, once the processor 122 has authenticated the signal to lock the deadbolt assembly 100, the processor 122 may instruct the plurality of LEDs 110 to visually communicate the directional illumination pattern that the latch 102 moves away from the door jamb 12 with a two LED sweeping motion. Starting with all of the LEDs turned off, the processor 122 may instruct LED 148 to be illuminated. Next, after a predetermined amount of time, T1, the LED 146 immediately next to LED 148 may be illuminated, such that only LEDs 148 and 146 may be illuminated. (As an alternate option, both LEDs 140 and 142 may be illuminated as the initial step). Next, again after the predetermined amount of time, T1, LED 144 may be illuminated, while turning off LED 148, such that only LEDs 146 and 144 may be illuminated. Again after a predetermined amount of time, T1, LED 142 may be illuminated, while turning off LED 146, such that only LEDs 144 and 142 may be illuminated. Lastly, after a predetermined amount of time, T1, LED 140 may be illuminated, while turning off LED 144, such that only LED 142 and 140 may be illuminated. Similar to described above, after a second predetermined amount of time, T2, all of the LEDs may turn off and then after a third predetermined amount of time, T3, only the two LEDs 142, 140 nearest the first end 112 may be illuminated and remain illuminated for a predetermined amount of time, T4. Table 6 below shows the time interval and which LEDs may be illuminated for each stage of the lock sequence. Other embodiments of a directional illumination pattern to visually communicate the movement of the latch 102 using a linear array of LEDs 110 from an unlocked position to a locked position may be obvious to one skilled in the art.

TABLE 6

| ALTERNATE UNLOCK SEQUENCE - UNLOCKING MOVEMENT LED SEQUENCE | |
|---|---|
| EXEMPLARY TIME INTERVAL | LEDs ILLUMINATED |
| — | NONE |
| T0 | Single LED 148 nearest to Door Jamb |
| T1 | LEDs 148, 146 |
| T1 | LEDs 146, 144 |
| T1 | LEDs 144, 142 |
| T1 | LEDs 142, 140 |
| T2 | NONE |
| T3 | LEDs 142, 140 |
| T4 | NONE |

An exemplary embodiment of the time sequence is described below. The predetermined time, T0, may be the amount of time before the first LED illuminates after the processor has authenticated the signal to move the latch 102 to the locked position. T0 may be approximately 150 ms or within a range of 100 ms to 200 ms. The predetermined time interval, T1, may be less than the time intervals T0, T2, T3, and T4 to give the appearance of motion as the plurality of LEDs 110 illuminate in succession. For example, T1 may be approximately 100 ms or within a range of 50 ms to 150 ms. T2 is the time that all of the LEDs remain illuminated after they have been sequentially illuminated and may be greater than the time interval T1. For instance, T2 may be approximately 300 ms or within the range of 200 ms to 400 ms. T3 is the time that the LEDs remain turned off after sequentially illuminating until an additional signal is given of the two LEDs 142, 140 closest to the door jamb 12 may be illuminated to give another indication that the latch 102 was moved toward the door jamb 12 to the locked position. The time interval, T3, may be greater than T0, T1, and T2 and may be approximately 1400 ms or within a range of 800 ms to 2000 ms. Lastly, T4 is the time that the LEDs 142, 140 remain illuminated. T4 may be greater than T1, T2, and T3 to give the user the longest visual cue that the latch has been moved to the locked position. T4 may be approximately 2000 ms or within a range of 1500 ms to 3000 ms. After the time interval T4, the LEDs 110 remain turned off until the next interaction of the deadbolt lock assembly 100 with the user.

In addition, or optionally to the visual communication provided by the plurality of LEDs 110, the deadbolt lock assembly 100 may also provide audible feedback to the user. This audible feedback may be different when communicating the locking motion than when communicating the unlocking motion. For example, the deadbolt lock assembly 100 may produce a single audible tone or "BEEP" to communicate that the latch 102 has been moved from the unlocked position to the locked position or two audible tones or "BEEPS" to communicate that the latch 102 has been moved from the locked position to the unlocked position. As another option, the plurality of LEDs 110 may light up in a different color for displaying the visual feedback for the movement of the latch 102 from an unlocked position to a locked position or for the movement of the latch 102 from a locked position to an unlocked position. For example, the plurality of LEDs 110 may illuminate in an "AMBER" color when visually communicating the movement of the latch 102 from an unlocked position to a locked position and the plurality of LEDs 110 may illuminate in a "GREEN" color when visually communicating the movement of the latch 102 from a locked position to an unlocked position.

Low Battery Deadbolt Assembly

In addition to communicating the direction of the latch 102 movement, the plurality of LEDs may also communicate other information to the user. For example, the processor 122 may determine if the power level of the power source 124 in the deadbolt lock assembly 100 is below a predetermined threshold level. If the processor 122 determines the power level of the power source 124 is low, the processor 122 may instruct the plurality of LEDs 110 to illuminate in a low power sequence and a specific pattern such as the most centrally located group of LEDs 110 may illuminate for a predetermined time, T5. For example, in the exemplary embodiment shown in FIG. 6, the three central LEDs 142, 144, 146 may illuminate for the predetermined time, T5, to communicate to the user that the battery 124 is low and needs to be replaced soon. The predetermined time T5 may be approximately 3000 ms or within a range of 2000 ms to 4000 ms.

Low Battery FOB

As another example of visually communicating other information to the user, within the signal received by the sensor 120 may be the remaining battery life within the key fob or wireless device 20. The processor 122 may determine when if power level of a key fob is below a predetermined threshold limit; and then upon determining the power level of the key fob is below a predetermined limit, then instruct the outermost located individual LEDs of the plurality of LEDs 110 to illuminate for a predetermined time, T6. For example, in the exemplary embodiment shown in FIG. 7, the two outer LEDs 140, 148 may illuminate for the predetermined time, T6, to communicate to the user that the battery within the key fob is low and needs to be replaced soon. The time T6 may be approximately 3000 ms or within a range of 2000 ms to 4000 ms.

By providing visual feedback to the user of illuminating the most centrally located or innermost group of LEDs 110 of the linear array, the visual communication of the deadbolt assembly 100 may imply to the user that the battery 124 inside the deadbolt assembly 100 may be low making it easier for the user to troubleshoot a problem compared to the difficulty for the user of remembering various illumination patterns or referring to a manual. Similarly, by visually communicating to the user by illuminating the outermost LEDs of the linear array, the visual communication of the deadbolt assembly 100 may imply to the user that the battery of the key fob, which is outside the deadbolt assembly 100, may be low making it easier for the user to troubleshoot a problem compared to the difficulty of remembering various illumination patterns or referring to a manual.

As another option, the plurality of LEDs 110 may light up in a different color when communicating low battery information than for displaying the visual feedback for the locking and unlocking motion. For example, the plurality of LEDs 110 may light up in a "RED" color when communicating low battery information.

Power Up Mode

Figure 8:
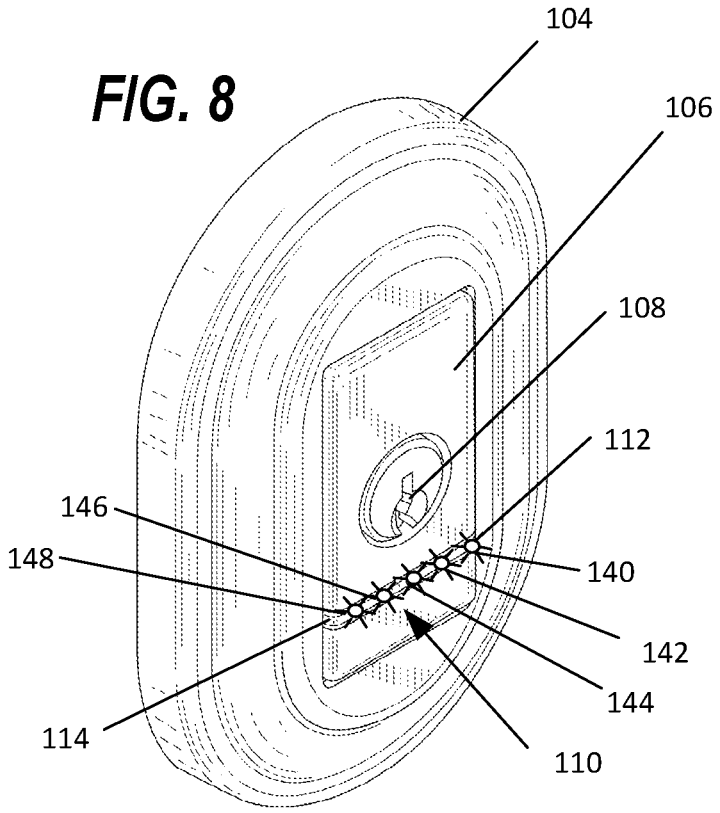
FIG. 8 illustrates a perspective view of the exterior assembly of the deadbolt lock assembly of FIG. 1 communicating a boot up sequence.

As another example of communicating other information to the user, during the boot up mode or power up mode of the system 100, as shown in FIG. 8, the processor 122 may instruct all of plurality of LEDs 110 to illuminate in cycles, such that each cycle lasts for a predetermined time, T7, and that during each cycle the LEDs light up in a different color. The plurality of LEDs 110 may illuminate with a first color and after a predetermined time, T7, change from the first color to a second color, then after another predetermined time, T7, change from the second color to a third color. This cycle may repeat for up to as many seven cycles, with the plurality of LEDs 110 being a different color for each cycle. For example, in the exemplary embodiment, the plurality of LEDs 110 may all light up and cycle from "WHITE," then "AMBER," then "RED," then "MAGENTA," then "BLUE," then "GREEN", then back to "WHITE," where the plurality of LEDs stay illuminated during each cycle for the predetermined time, T7. The predetermined time T7 may be approximately 350 ms for each color, or within a range of 250 ms to 450 ms for each color.

By providing visual feedback to the user of illuminating all of the LEDs in sequence and cycling through all of the colors during the power up mode visually communicates to the user gives clear visual feedback to the user that the all of the LEDs are working properly.

Figure 9A:
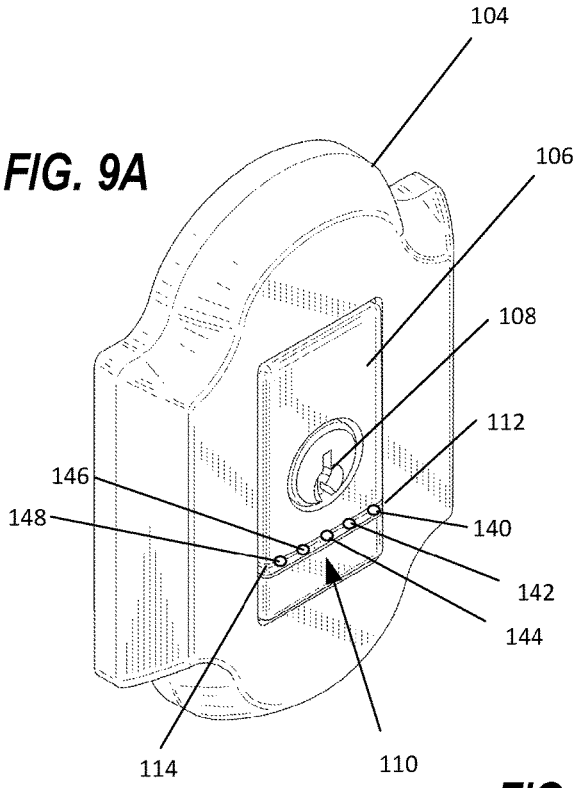
FIGS. 9A and 9B illustrate perspective views of alternate configurations of the exterior assembly.
Figure 9B:
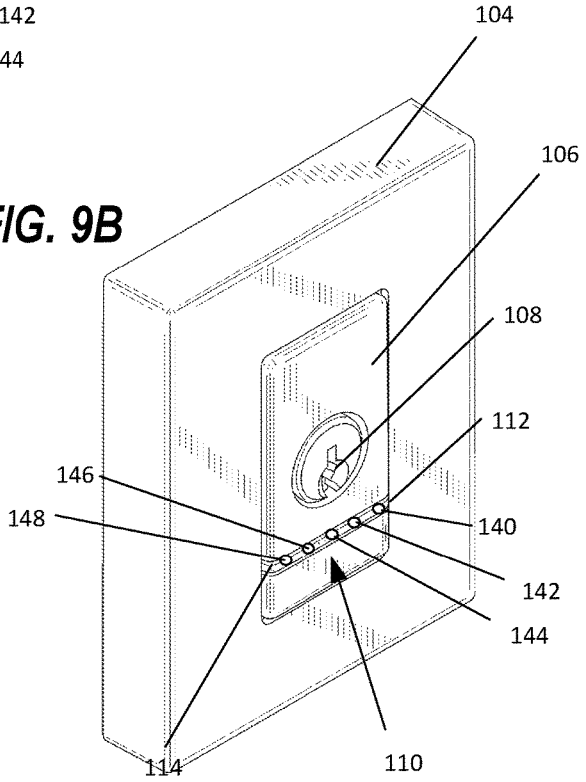

It is noted that while the FIGS. 1 and 4A-8 depict an exterior assembly 104 with one desired aesthetic appearance, it is noted that exterior assembly 104 may have any desired shape and/or configuration to achieve any desired aesthetic appearance. For example, FIGS. 9A-9B show alternate shapes of the exterior assembly 104. Additionally, the appearance of the faceplate 106 of the exterior assembly 104 may have alternative shapes and configurations as well including but not limited alternative sizes, shapes, and/or relative positions of the LED strip 110 and the keyway 108. Accordingly, the exterior assembly 104 is not limited to the shapes shown in this disclosure.

While various embodiments have been described, it will be apparent to those of ordinary skill in the art that many more embodiments and implementations are possible that are within the scope of the claims. The various dimensions or time ranges described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

What is claimed is:

1. A deadbolt lock assembly comprising:

a latch for locking and unlocking a door in which the deadbolt lock assembly is engaged; and an exterior assembly in communication with the latch comprising a plurality of LEDs aligned in a linear array located on the exterior assembly wherein the linear array has a first end furthest from a door jamb and a second end nearest the door jamb, and wherein the plurality of LEDs comprises at least three LEDs, wherein the plurality of LEDs illuminate in a sequence that moves in the same direction as a movement of the latch when the latch moves to either a locked position or an unlocked position.

2. The deadbolt lock assembly of claim 1, wherein the plurality of LEDs are evenly spaced apart and wherein the plurality of LEDs are arranged in a horizontal linear array and are oriented substantially parallel to the latch; and wherein the exterior assembly further comprises a keyway.

3. The deadbolt lock assembly of claim 2, wherein the plurality of LEDs comprises five LEDs, wherein a first LED is positioned nearest the first end, a second LED positioned next to the first LED towards the second end, a third LED positioned next to the second LED in a center of the horizontal linear array, a fourth LED next to the third LED, and a fifth LED nearest the second end.

4. The deadbolt lock assembly of claim 1, further comprising a processor, wherein the processor is connected to a power source and the plurality of LEDs, and a non-transitory computer readable medium storing computer readable instructions that, when executed by the processor, causes the processor to at least:

authenticate a signal from a wireless device to move the latch to the locked position or the unlocked position;

instruct the plurality of LEDs to illuminate in a lock sequence when the signal is to move the latch to the locked position; and instruct the plurality of LEDs to illuminate in an unlock sequence when the signal is to move the latch to the unlocked position, wherein the lock sequence is different than the unlock sequence.

5. The deadbolt lock assembly of claim 4, wherein the lock sequence includes illuminating the plurality of LEDs in a sequence that moves in the same direction as a movement of the latch from the unlocked position to the locked position such that the LED illumination sequence moves toward the door jamb.

6. The deadbolt lock assembly of claim 5, wherein the lock sequence includes the plurality of LEDs illuminating starting with a first LED nearest the first end illuminates first and then each remaining LED individually and sequentially illuminates starting with the LED immediately next to the first LED after a predetermined time, T1, until all of the plurality of LEDs are illuminated.

7. The deadbolt lock assembly of claim 6, wherein the lock sequence further includes upon waiting a predetermined time, T2, instruct all of the plurality of LEDs to turn off; and upon waiting a predetermined time, T3, instruct a first and a second LED nearest the second end of the linear array to illuminate.

8. The deadbolt lock assembly of claim 4, wherein the unlock sequence includes illuminating the LEDs in a sequence to illuminate in a pattern that moves in the same direction as a movement of the latch from the locked position to the unlocked position such that the LED illumination sequence moves away from the door jamb.

9. The deadbolt lock assembly of claim 8, wherein the unlock sequence includes the plurality of LEDs illuminating starting with a first LED nearest the second end illuminates first and then each remaining LED individually and sequentially illuminates after a predetermined time, T1, until all of the plurality of LEDs are illuminated.

10. The deadbolt lock assembly of claim 9, wherein the unlock sequence further includes upon waiting a predetermined time, T2, instruct all of the plurality of LEDs to turn off; and upon waiting a predetermined time, T3, instruct a first and a second LED nearest first end of the linear array to illuminate.

11. The deadbolt lock assembly of claim 1, further comprising a processor, wherein the processor is connected to a power source and the plurality of LEDs, and a non-transitory computer readable medium storing computer readable instructions that, when executed by the processor, causes the processor to at least:

determine when a power level of the power source is below a predetermined threshold limit; and upon determining the power level of the power source is below the predetermined threshold limit, instruct the plurality of LEDs to illuminate in a low power sequence, wherein the low power sequence includes the plurality of LEDs illuminating with the most centrally located LEDs illuminating and remaining illuminated for a predetermined time, T.

12. The deadbolt lock assembly of claim 1, further comprising a processor, wherein the processor is connected to a power source and the plurality of LEDs, and a non-transitory computer readable medium storing computer readable instructions that, when executed by the processor, causes the processor to at least:

determine when a power level of a key fob is below a predetermined threshold limit; and upon determining the power level of the key fob is below a predetermined limit, instruct the outermost located LEDs to illuminate and remain illuminated for a predetermined time, T.

13. The deadbolt lock assembly of claim 1, further comprising a processor, wherein the processor is connected to a power source and the plurality of LEDs, and a non-transitory computer readable medium storing computer readable instructions that, when executed by the processor, causes the processor to at least:

during a power up phase, instruct all of the plurality of LEDs to illuminate with a first color;

after a predetermined time, T, instruct all of the plurality of LEDs to illuminate and change from the first color to a second color different from the first color; and after another predetermined time, T, instruct all of the plurality of LEDs to illuminate and change from the second color to a third color different from the first color and the second color.

14. A deadbolt lock assembly comprising:

a latch for locking and unlocking a door in which the deadbolt lock assembly is engaged;

an exterior assembly in communication with the latch comprising a face plate, a keyway, and a plurality of LEDs aligned in a horizontal linear array located on the face plate wherein the horizontal linear array has a first end furthest from a door jamb and a second end nearest the door jamb;

a processor, wherein the processor is connected to a power source and the plurality of LEDs, and a non-transitory computer readable medium storing computer readable instructions that, when executed by the processor, causes the processor to at least:

authenticate a signal from a wireless device to move the latch to a locked position or an unlocked position;

instruct the plurality of LEDs to illuminate in a lock sequence when the signal is to move the latch to the locked position, wherein the lock sequence includes the plurality of LEDs illuminating starting with a first LED nearest the first end illuminates first and then each remaining LED individually and sequentially illuminates starting with an LED immediately next to the first LED after a predetermined time, T1, until all of the plurality of LEDs are illuminated; and instruct the plurality of LEDs to illuminate in an unlock sequence when the signal is to move the latch to the unlocked position, wherein the unlock sequence includes the plurality of LEDs illuminating starting with a first LED nearest the second end illuminates first and then each remaining LED individually and sequentially illuminates after the predetermined time, T1, until all of the plurality of LEDs are illuminated.

15. The deadbolt lock assembly of claim 14, wherein the lock sequence further includes upon waiting a predetermined time, T2, instruct all of the plurality of LEDs to turn off; and upon waiting a predetermined time, T3, instruct a first and a second LED nearest the second end of the horizontal linear array to illuminate.

16. The deadbolt lock assembly of claim 15, wherein the unlock sequence further includes upon waiting a predetermined time, T2, instruct all of the plurality of LEDs to turn off; and upon waiting a predetermined time, T3, instruct a first and a second LED nearest first end of the horizontal linear array to illuminate.

17. The deadbolt lock assembly of claim 14, wherein the plurality of LEDs comprises five LEDs, wherein a first LED is positioned nearest the first end, a second LED positioned next to the first LED towards the second end, a third LED positioned next to the second LED in a center of the horizontal linear array, a fourth LED next to the third LED, and a fifth LED nearest the second end.

18. A deadbolt lock assembly comprising:

a latch for locking and unlocking a door in which the deadbolt lock assembly is engaged;

an exterior assembly in communication with the latch comprising a face plate, a keyway, and a plurality of LEDs aligned in a linear array located on the face plate wherein the linear array has a first end furthest from a door jamb and a second end nearest the door jamb;

a processor, wherein the processor is connected to a power source and the plurality of LEDs, and a non-transitory computer readable medium storing computer readable instructions that, when executed by the processor, causes the processor to at least:

authenticate a signal from a wireless device to move the latch to a locked position or an unlocked position;

instruct the plurality of LEDs to illuminate in a lock sequence when the signal is to move the latch to the locked position;

instruct the plurality of LEDs to illuminate in an unlock sequence when the signal is to move the latch to the unlocked position, wherein the lock sequence is different than the unlock sequence; and determine when a power level of the power source is below a predetermined threshold limit and upon determining the power level of the power source is below the predetermined threshold limit, instruct the plurality of LEDs to illuminate in a low power sequence, wherein the low power sequence is different from the lock sequence and the unlock sequence.

19. The deadbolt lock assembly of claim 18, wherein the low power sequence includes the plurality of LEDs illuminating with the most centrally located LEDs illuminating and remaining illuminated for a predetermined time, T.

20. The deadbolt lock assembly of claim 14, wherein the lock sequence includes the plurality of LEDs illuminating starting with a first LED nearest the first end illuminates first and then each remaining LED individually and sequentially illuminates starting with the LED immediately next to the first LED after a predetermined time, T1, until all of the plurality of LEDs are illuminated and wherein the unlock sequence includes the plurality of LEDs illuminating starting with a first LED nearest the second end illuminates first and then each remaining LED individually and sequentially illuminates after the predetermined time, T1, until all of the plurality of LEDs are illuminated.

* * * * *